US011624988B2

(12) United States Patent
Son et al.

(10) Patent No.: US 11,624,988 B2
(45) Date of Patent: Apr. 11, 2023

(54) TONER SUPPLY DUCT PIVOTABLE TO ALLOW ROTATION OF DEVELOPMENT CARTRIDGE

(71) Applicant: Hewlett-Packard Development Company, L.P., Spring, TX (US)

(72) Inventors: Janghyun Son, Suwon (KR); Jongin Kim, Suwon (KR); Jeonghuyn Lee, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/298,541

(22) PCT Filed: Jan. 27, 2020

(86) PCT No.: PCT/US2020/015146

§ 371 (c)(1),
(2) Date: May 29, 2021

(87) PCT Pub. No.: WO2021/040782

PCT Pub. Date: Mar. 4, 2021

(65) Prior Publication Data

US 2022/0214632 A1 Jul. 7, 2022

(30) Foreign Application Priority Data

Aug. 29, 2019 (KR) ..... 10-2019-0106310

(51) Int. Cl.
*G03G 15/08* (2006.01)

(52) U.S. Cl.
CPC ..... *G03G 15/0877* (2013.01)

(58) Field of Classification Search
CPC ..... G03G 15/0877; G03G 21/1676; G03G 21/1825; G03G 2221/1654;
(Continued)

(56) References Cited

U.S. PATENT DOCUMENTS 9,465,320 B1 10/2016 Kim
2007/0077097 A1 4/2007 Watanabe
(Continued)

FOREIGN PATENT DOCUMENTS

JP 1997218575 2/1996
JP 2000098841 9/1998
(Continued)

*Primary Examiner* — Sandra Brase
(74) *Attorney, Agent, or Firm* — Foley & Lardner LLP

(57) ABSTRACT

An example image forming apparatus includes a toner cartridge, a photoconductive cartridge including a photosensitive drum, a development cartridge including a toner inlet portion and rotatable between a first position at which a developing roller is close to the photosensitive drum and a second position at which the developing roller is apart from the photosensitive drum, with respect to a hinge axis that is parallel to an axial direction of the developing roller and between the developing roller and the toner inlet portion, a buffer unit including a toner discharge portion to receive toner from the toner cartridge and to supply the toner to the development cartridge, and a toner supply duct connecting the toner discharge portion to the toner inlet portion, the toner supply duct being rotatably connected to the toner discharge portion in a direction allowing rotation of the development cartridge between the first and the second position.

15 Claims, 10 Drawing Sheets

(58) Field of Classification Search
CPC ..... G03G 15/0879; G03G 15/0875; G03G 15/0865; G03G 2215/0634
See application file for complete search history.

(56) References Cited

U.S. PATENT DOCUMENTS

| | | | | |
|---|---|---|---|---|
| 2011/0150536 | A1 | 6/2011 | Choi | |
| 2013/0202329 | A1* | 8/2013 | Akedo ..... | G03G 15/0893 399/258 |
| 2017/0199482 | A1 | 7/2017 | Moon et al. | |
| 2017/0219960 | A1 | 8/2017 | Sato | |
| 2018/0136583 | A1* | 5/2018 | Park ..... | G03G 15/0865 |
| 2018/0188682 | A1 | 7/2018 | Kim et al. | |

FOREIGN PATENT DOCUMENTS

| | | |
|---|---|---|
| JP | 2000162861 | 9/1999 |
| JP | 2006113137 | 4/2006 |
| JP | 2009300859 | 12/2009 |
| JP | 2011197291 | 3/2010 |
| JP | 2017021102 | 7/2015 |

* cited by examiner

TONER SUPPLY DUCT PIVOTABLE TO ALLOW ROTATION OF DEVELOPMENT CARTRIDGE

BACKGROUND

An image forming apparatus using an electrophotographic method supplies toner to an electrostatic latent image formed on a photoconductor to form a visible toner image on the photoconductor, transfers the toner image via an intermediate transfer medium or directly to a print medium, and fixes the transferred toner image on the print medium.

A development cartridge contains toner and supplies the toner to the electrostatic latent image formed on the photoconductor to form the visible toner image. In certain circumstances, such as when the toner contained in the development cartridge is used up, the development cartridge may be removed from a main body of the image forming apparatus and a new development cartridge may be mounted in the main body.

DETAILED DESCRIPTION OF EXAMPLES

Figure 1:
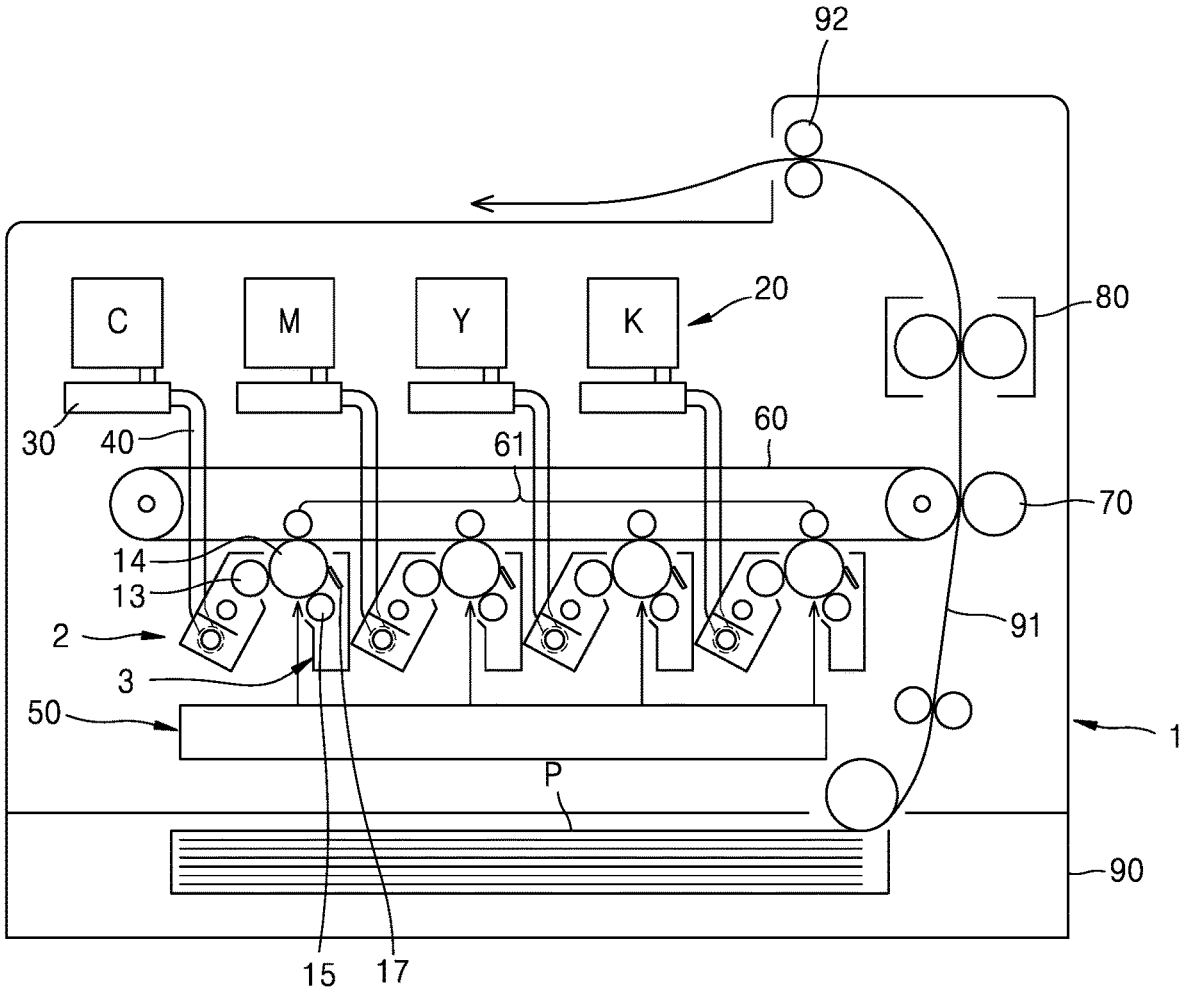
FIG. 1 is a schematic configuration diagram of an electrophotographic image forming apparatus, according to an example.

Reference will now be made to examples that are illustrated in the accompanying drawings. The same reference numerals are used to denote the same elements, and repeated descriptions thereof will not be given herein.

FIG. 1 is a schematic configuration diagram of an electrophotographic image forming apparatus, according to an example. In the following example, the image forming apparatus prints a color image on a print medium P by using an electrophotographic method.

Referring to FIG. 1, the image forming apparatus may include a development cartridge 2, a photoconductive cartridge 3, an optical scanner 50, a transfer unit, and a fuser 80.

The photoconductive cartridge 3 may include a photosensitive drum 14. The photosensitive drum 14 is an example of a photoconductor that may have an electrostatic latent image formed on a surface thereof, and may include a conductive metal pipe and a photosensitive layer on an outer circumference of the conductive metal pipe. A charging roller 15 is an example of a charger to charge the photosensitive drum 14 such that the photosensitive drum 14 has a uniform surface electric potential. A charging brush, a corona charger, or the like may be used instead of the charging roller 15. A cleaning member 17 may remove foreign substances remaining on the surface of the photosensitive drum 14 after an intermediate transfer process, an example of which will be described later. Although not illustrated in the drawing, the photoconductive cartridge 3 may further include a charging roller cleaner to remove foreign substances such as a developing agent or dust from the charging roller 15.

The development cartridge 2 includes a developing roller 13. The developing roller 13 is to develop the electrostatic latent image into a visible toner image by supplying a toner to the electrostatic latent image formed on the photosensitive drum 14. Although not illustrated in the drawing, the development cartridge 2 may further include a regulating member to regulate an amount of a developing agent supplied to a development area where the photosensitive drum 14 and the developing roller 13 face each other. The development cartridge 2 according to an example may form a toner image by using a two-component developing method in which a toner and a carrier are used as a developing agent. The developing roller 13 may be arranged apart from the photosensitive drum 14. A distance between an outer circumferential surface of the developing roller 13 and an outer circumferential surface of the photosensitive drum 14 may be, for example, about tens to about hundreds of micrometers. The developing roller 13 may include a rotating development sleeve and a magnet arranged fixedly inside the development sleeve (so as not to rotate). The toner and the carrier may be mixed in the development cartridge 2, and the toner is attached to a surface of a magnetic carrier. The magnetic carrier is attached to a surface of the developing roller 13 to be transported to the development area where the photosensitive drum 14 and the developing roller 13 face each other. The regulating member (not shown) is to regulate an amount of the developing agent transported to the development area. According to a development bias voltage applied between the developing roller 13 and the photosensitive drum 14, toner may be supplied to the photosensitive drum 14 to develop the electrostatic latent image formed on the surface of the photosensitive drum 14, into a visible toner image.

For color printing, the development cartridge 2 may include a plurality of development cartridges 2C, 2M, 2Y, and 2K for respectively forming color images of cyan (C), magenta (M), yellow (Y), and black (K) colors. Hereinafter, unless otherwise stated, reference numerals labeled with C, M, Y, and K respectively refer to components for developing agents of cyan (C), magenta (M), yellow (Y), and black (K) colors.

The optical scanner 50 may form an electrostatic latent image on the photosensitive drum 14 by irradiating the photosensitive drum 14 with light modulated in correspondence with image information. As the optical scanner 50, a laser scanning unit (LSU) using a laser diode as a light source, a light emitting diode (LED) optical scanner using an LED as a light source, or the like may be used.

The transfer unit may transfer the toner image formed on the photosensitive drum 14 onto the print medium P. In an example, a transfer unit using an intermediate transfer method is used. For example, the transfer unit may include an intermediate transfer belt 60, an intermediate transfer roller 61, and a transfer roller 70.

The intermediate transfer belt 60 is to temporarily accommodate the toner image developed on the photosensitive drum 14 of a plurality of photoconductive cartridges 3C, 3M, 3Y, and 3K. A plurality of intermediate transfer rollers 61 may be arranged at a position facing the photosensitive drum 14 of the plurality of photoconductive cartridges 3C, 3M, 3Y, and 3K, with the intermediate transfer belt 60 therebetween. An intermediate transfer bias voltage for intermediately transferring the toner image developed on the photosensitive drum 14, to the intermediate transfer belt 60, may be applied to the plurality of intermediate transfer rollers 61. Instead of the intermediate transfer rollers 61, a corona transfer unit or a pin scorotron-type transfer unit may be used.

The transfer roller 70 is positioned to face the intermediate transfer belt 60. A transfer bias voltage for transferring the toner image transferred to the intermediate transfer belt 60, to the print medium P, may be applied to the transfer roller 70.

The fuser 80 is to apply heat and/or pressure to the toner image transferred onto the print medium P, thereby fusing the print medium P. The form of the fuser 80 is not limited to the example illustrated in FIG. 1.

According to an example as described above, the optical scanner 50 may form an electrostatic latent image on the photosensitive drum 14 by scanning the light modulated in correspondence with image information of the colors onto the photosensitive drum 14 of the plurality of photoconductive cartridges 3C, 3M, 3Y, and 3K. The electrostatic latent image of the photosensitive drum 14 of the plurality of photoconductive cartridges 3C, 3M, 3Y, and 3K is developed into a visible toner image by C, M, Y, and K toners supplied from a plurality of toner cartridges 20C, 20M, 20Y, and 20K to the plurality of development cartridges 2C, 2M, 2Y, and 2K. Each of the toner cartridges 20C, 20M, 20Y, and 20K may be respectively connected to the plurality of development cartridges 2C, 2M, 2Y, and 2K via a buffer unit 30 and a toner supply duct 40. The developed toner images are sequentially and intermediately transferred to the intermediate transfer belt 60. The print medium P loaded in a feeding unit 90 is transported along a feed path 91 to be transported between the transfer roller 70 and the intermediate transfer belt 60. The toner image that is intermediately transferred onto the intermediate transfer belt 60 via the transfer bias voltage applied to the transfer roller 70 is transferred to the print medium P. As the print medium P passes through the fuser 80, the toner image is fused on the print medium P by the heat and pressure. The fusing-completed print medium P is discharged using a discharge roller 92.

The development cartridge 2 and the photoconductive cartridge 3 are consumables that may be replaced, such as when their service life is over, to address a malfunction, or the like. The development cartridge 2 and the photoconductive cartridge 3 may be individually attached/detached to/from a main body 1. The development cartridge 2 and the photoconductive cartridge 3 may each slide in a first direction A1 (FIG. 2) in parallel to an axial direction of the developing roller 13 to be attached/detached to/from the main body 1. As described above, the developing roller 13 faces the photosensitive drum 14 to form a development area. In the development area, a surface of the developing roller 13 is arranged apart from a surface of the photosensitive drum 14 by about several hundreds of micrometers. In this state, when the development cartridge 2 or the photoconductive cartridge 3 is attached or detached, the photosensitive drum 14 may interfere with the development cartridge 2 and may be damaged. Considering this, the development cartridge 2 may be switched between a first position (indicated with a solid line in FIG. 2), in which the developing roller 13 approaches the photosensitive drum 14 to form a development area, and a second position (indicated with a dotted line in FIG. 2), in which the developing roller 13 is separated apart from the photosensitive drum 14 to release the development area.

Figure 2:
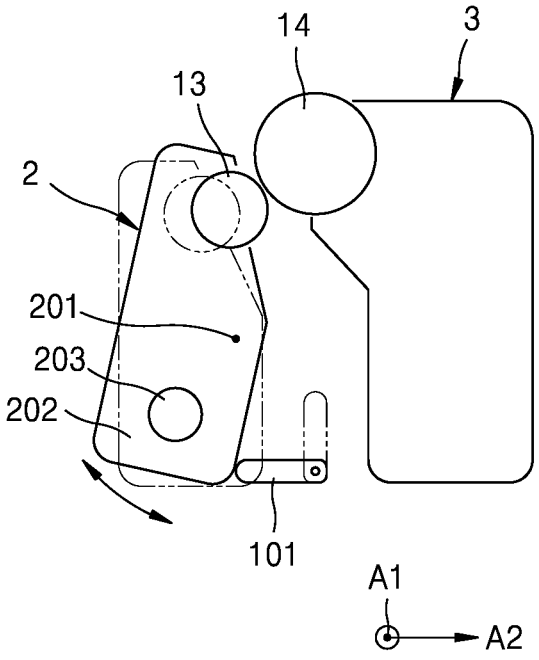
FIG. 2 is a schematic view of a structure in which a development cartridge is switched between a first position and a second position, according to an example.

FIG. 2 is a schematic view of a structure in which a development cartridge is switched between a first position and a second position, according to an example.

Referring to FIG. 2, when the development cartridge 2 is mounted in the main body 1, the development cartridge 2 is rotatably supported between a first position (indicated with a solid line) and a second position (indicated with a dotted line) with respect to a hinge axis 201. The hinge axis 201 is parallel to the first direction A1. A position of the hinge axis 201 may be determined such that the development cartridge 2 is rotatable toward the second position by the weight of the development cartridge 2 itself. Alternatively, the development cartridge 2 may be elastically biased in a direction of the second position by an elastic member (not shown). The hinge axis 201 may be provided in the development cartridge 2 or may be provided by a bracket (not shown) that is located in the main body 1 to accommodate a portion (e.g., a side portion) of the development cartridge 2. In this case, the bracket may be rotatably installed in the main body 1 to rotate with respect to the hinge axis 201.

A switch lever 101 may be provided in the main body 1. After mounting the development cartridge 2 in the main body 1, the switch lever 101 may be switched to a development position (indicated with a solid line). The switch lever 101 may push the development cartridge 2 to rotate the development cartridge 2 with respect to the hinge axis 201 from the second position toward the first position. Based on the rotation of the development cartridge 2, the developing roller 13 may approach the photosensitive drum 14 to form a development area.

When removing the development cartridge 2 or the photoconductive cartridge 3, the switch lever 101 may be switched to a removal position (indicated with a dotted line). In that case, the development cartridge 2 may be rotated with respect to the hinge axis 201 toward the second position via its own weight or an elastic force of an elastic member (not shown). Accordingly, the developing roller 13 may be spaced apart from the photosensitive drum 14 and the development area may be released. In this state, by sliding the development cartridge 2 or the photoconductive cartridge 3 in a direction parallel to an axial direction of the developing roller 13, the development cartridge 2 or the photoconductive cartridge 3 may be removed from the main body 1. Because the developing roller 13 is spaced apart from the photosensitive drum 14, damage to the photosensitive drum 14 during a removal process may be reduced or prevented.

A toner may be supplied from the toner cartridge 20 to the development cartridge 2. The toner cartridge 20 may accommodate a toner and a carrier. The toner cartridge 20 is a consumable that may be replaced, such as when toner accommodated therein is used up. The toner cartridge 20 may be attached/detached to/from the main body 1. In an image forming apparatus forming a color image, the toner cartridge 20 may include a plurality of toner cartridges 20C, 20M, 20Y, and 20K respectively accommodating cyan (C), magenta (M), yellow (Y), and black (K) colors to be supplied to the plurality of development cartridges 2C, 2M, 2Y, and 2K.

Figure 3:
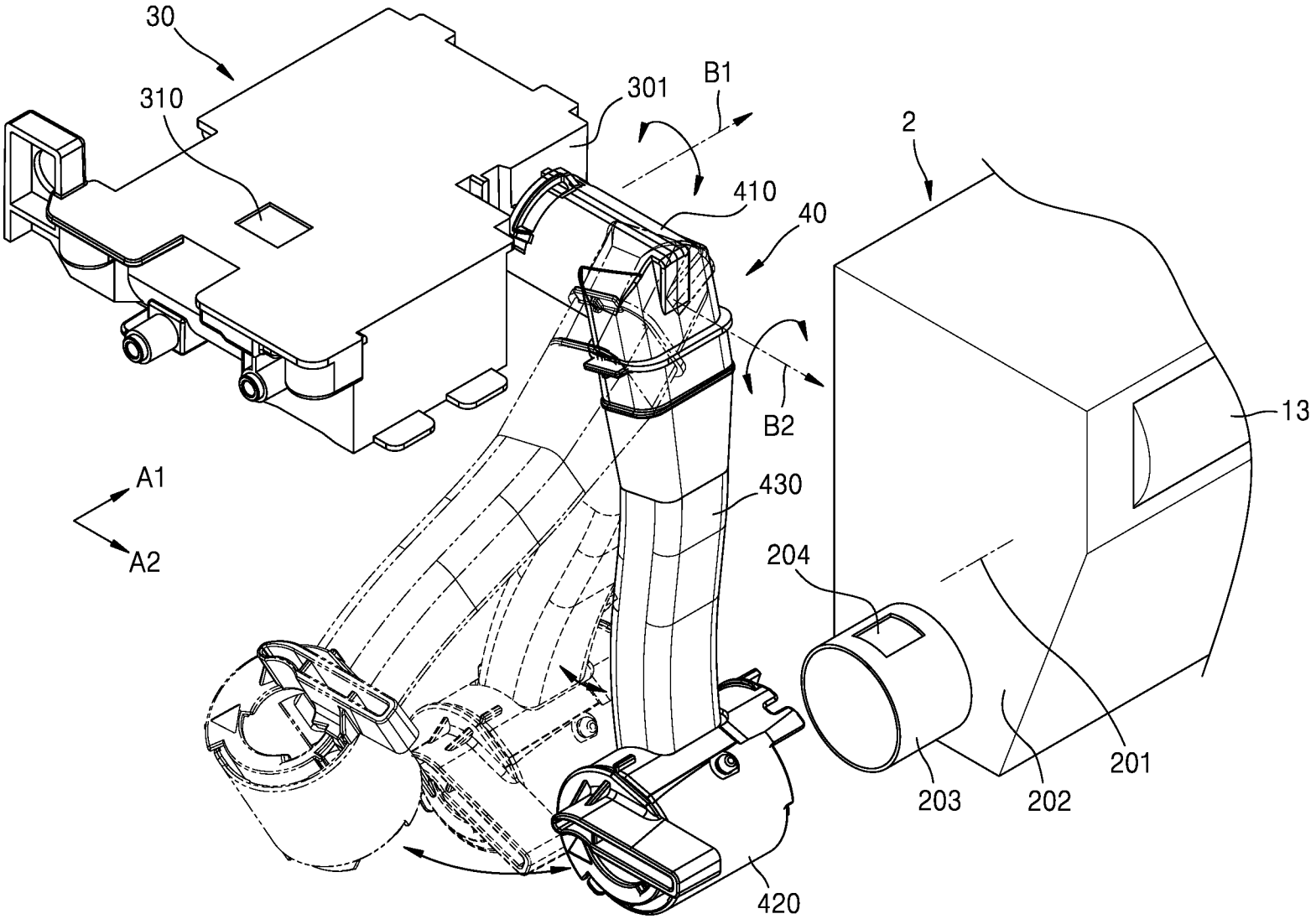
FIG. 3 is a perspective view of a connection structure between a development cartridge and a buffer unit, according to an example.
Figure 4:
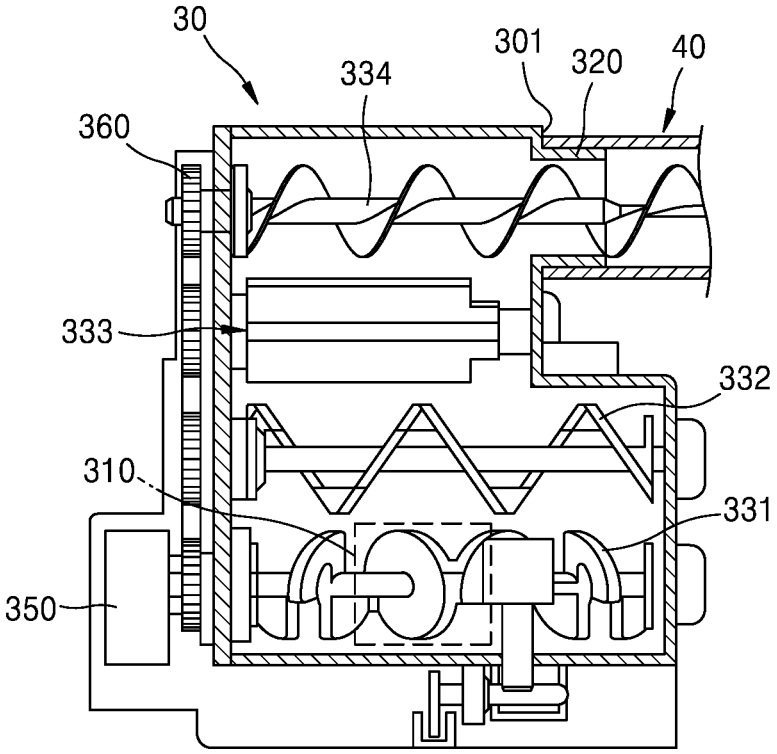
FIG. 4 is a schematic plan view of a buffer unit, according to an example.

FIG. 3 is a perspective view of a connection structure between a development cartridge and a buffer unit, according to an example. FIG. 4 is a schematic plan view of a buffer unit, according to an example.

Referring to FIGS. 3 and 4, the toner cartridge 20 may be connected to the development cartridge 2 via the buffer unit 30 and a toner supply duct 40. The buffer unit 30 may receive toner from the toner cartridge 20 and may supply toner to the development cartridge 2. The buffer unit 30 may be connected to the development cartridge 2 via the toner supply duct 40.

The buffer unit 30 includes an inlet portion 310 through which toner may be introduced from the toner cartridge 20. The buffer unit 30 also includes a toner discharge portion 320 forming a discharge path to discharge toner to the development cartridge 2. The toner supply duct 40 may be connected to the toner discharge portion 320. A transporting member to transport toner introduced through the inlet portion 310 to the toner discharge portion 320 is provided in the buffer unit 30. According to an example, the transporting member may include transporting members 331, 332, 333, and 334 arranged from the inlet portion 310 to the toner discharge portion 320. The toner introduced from the toner cartridge 20 to the buffer unit 30 through the inlet portion 310 may be transported to the toner discharge portion 320 via the transporting members 331, 332, 333, and 334.

The transporting member 331 may include a rotational shaft and spiral transport wings to transport toner in an axial direction. The transport wings may include two transport wings having opposite spiral directions to each other. As the transporting member 331 rotates, toner may be gathered toward a center of the transporting member 331 where two transport wings are connected and pushed to be transported toward the transporting member 332. The transporting member 332 may stir the toner in the buffer unit 30 to prevent the toner from agglomerating. The transporting member 333 may transport the toner in the buffer unit 30 in a radial direction. To this end, the transporting member 333 may include a rotational shaft and paddle-type transport wings extending from the rotational shaft in a radial direction. The transport member 334 may discharge toner through the toner discharge portion 320. The transport member 334 may include an auger including a rotational shaft and spiral wings to transport toner in an axial direction. The transport member 334 may extend into the toner discharge portion 320. The number and shape of the transporting members are not limited to the example illustrated in FIG. 4.

A driving motor 350 to drive the transporting members 331, 332, 333, and 334 may be provided in the buffer unit 30. The driving motor 350 may be connected to the transporting members 331, 332, 333, and 334 via a power connection structure such as a gear train 360. Although not illustrated in the drawings, the buffer unit 30 may include a toner remaining amount sensor. As an example, the toner remaining amount sensor may detect a toner level in the buffer unit 30.

The buffer unit 30 may be connected to the development cartridge 2 via the toner supply duct 40. Referring to FIG. 3, a toner inlet portion 203 is provided in the development cartridge 2. The toner inlet portion 203 may protrude from a side wall 202 of the development cartridge 2 in the first direction A1. The toner inlet portion 203 may be in a cylinder form. An opening 204 through which toner may be introduced into the development cartridge 2 is provided in the toner inlet portion 203.

The toner supply duct 40 may include a first connecting portion 410 to connect to the toner discharge portion 320, a second connecting portion 420 to connect to the toner inlet portion 203, and a connection tube 430 to connect the first connecting portion 410 to the second connecting portion 420. In an example, the connection tube 430 may be formed of an elastic material, such as rubber.

As described above, the development cartridge 2 may be rotated with respect to the hinge axis 201 to be rotated between the first position and the second position. The hinge axis 201, which is a center of rotation of the development cartridge 2, extends in the first direction A1 and is positioned between the developing roller 13 and the toner inlet portion 203. That is, with respect to the hinge axis 201, the developing roller 13 is located above the hinge axis 201, and the toner inlet portion 203 is located below the hinge axis 201. When the development cartridge 2 is rotated toward the second position, the toner inlet portion 203 is drawn toward the buffer unit 30. As the toner supply duct 40 is between the buffer unit 30 and the development cartridge 2, a repulsive force disturbing rotation of the development cartridge 2 toward the second position may be generated by the toner supply duct 40. Even when the connection tube 430 is formed of an elastic material, when a repulsive force due to the elasticity of the connection tube 430 is greater than a rotational force of the development cartridge 2 by its own weight, the development cartridge 2 may not be rotated to the second position. In that case, the development area may not be properly released and interference with the development cartridge 2 may occur when attaching or detaching the photoconductive cartridge 3. In addition, when the weight of the development cartridge 2 itself or the elasticity of the elastic member are sufficiently greater than the repulsive force of the connection tube 430, the connection tube 430 may be deformed, such as by bending. In that case, toner supply through the connection tube 430 may be impeded.

In an example, the toner supply duct 40 may be connected to the toner discharge portion 320 to pivot in a direction allowing rotation of the development cartridge 2 between the first position and the second position.

According to an example, the toner discharge portion 320 extends from a side wall 301 of the buffer unit 30 in a second direction A2. The second direction A2 is a direction orthogonal to the first direction A1, which is parallel to an axial direction of the developing roller 13. To allow rotation of the development cartridge 2 between the first position and the second position, the first connecting portion 410 may be connected to the toner discharge portion 320 to be pivoted relative to a first axis B1 parallel to the first direction A1.

Figure 5:
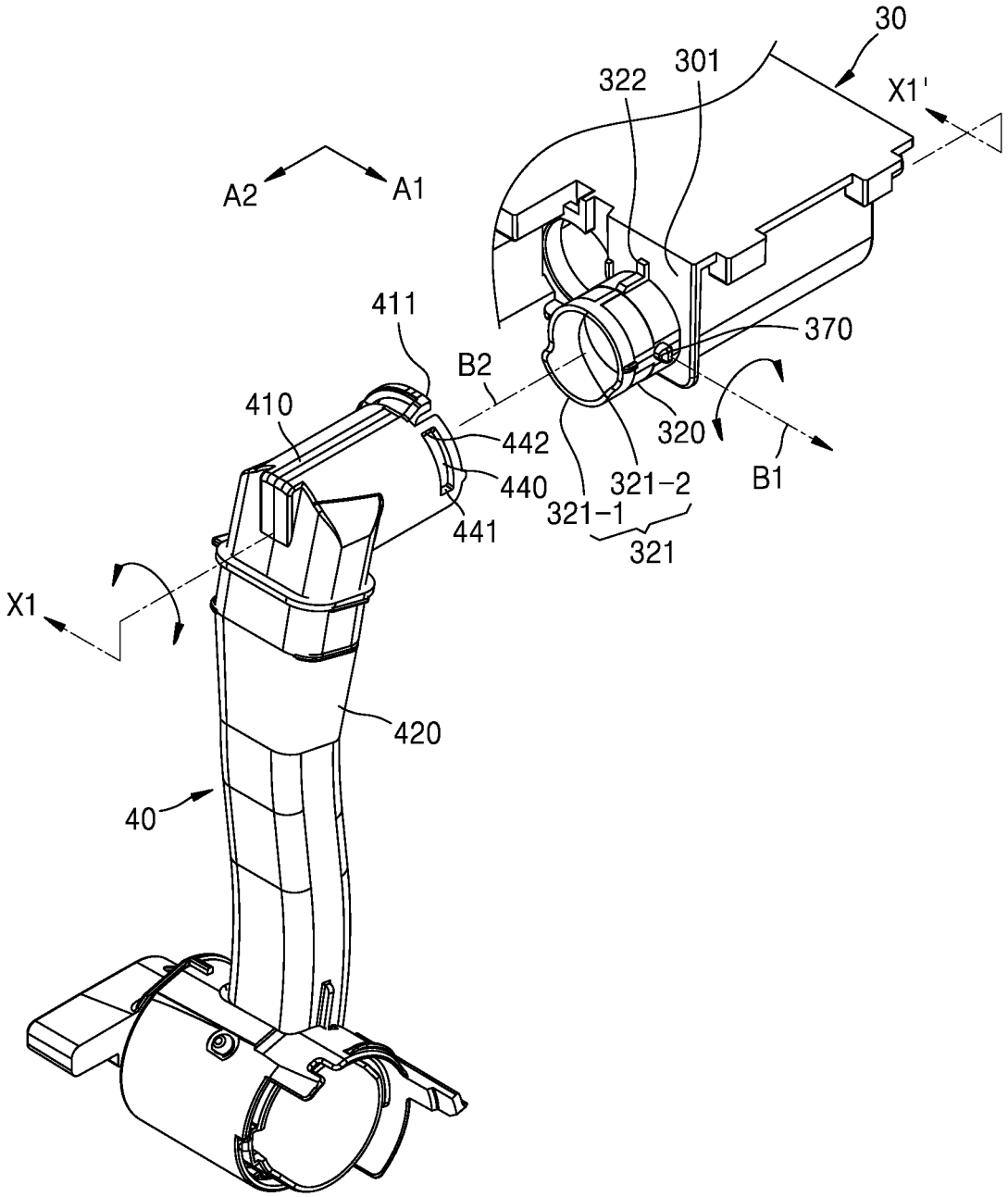
FIG. 5 is a disassembled perspective view of a connection structure between a toner discharge portion and a first connecting portion, according to an example.
Figure 6:
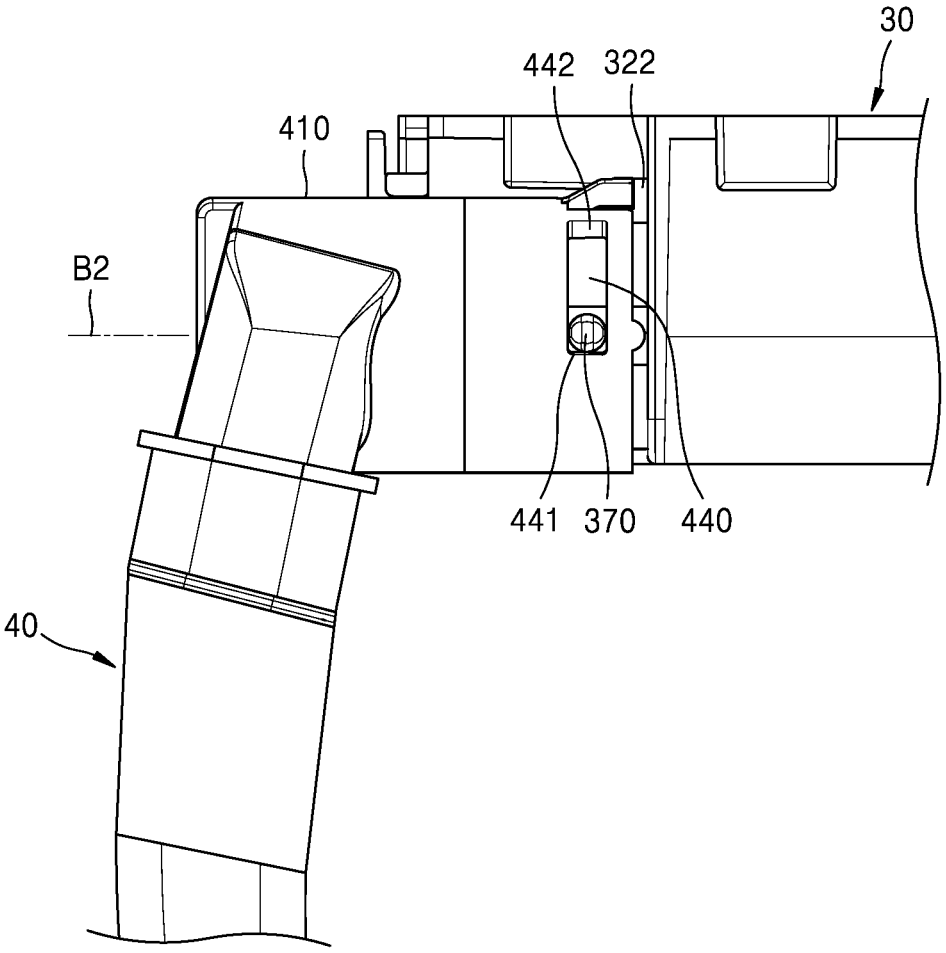
FIG. 6 is a side view of FIG. 5 taken in a first direction, according to an example.

FIG. 5 is a disassembled perspective view of a connection structure between a toner discharge portion and a first connecting portion, according to an example. FIG. 6 is a side view of FIG. 5 taken in a first direction, according to an example.

Referring to FIGS. 5 and 6, the toner discharge portion 320 may be in the form of a hollow cylinder extending from the side wall 301 in the second direction A2. The toner discharge portion 320 may be inserted into the first connecting portion 410. The first connecting portion 410 may be in the form of a hollow cylinder into which the toner discharge portion 320 may be inserted. A hinge protrusion 370 protruding along the first axis B1 is provided on the toner discharge portion 320. A hinge hole 440 into which the hinge protrusion 370 may be inserted is provided in the first connecting portion 410. As the hinge protrusion 370 is inserted into the hinge hole 440, the first connecting portion 410 is connected to the toner discharge portion 320 to be pivotable relative to the first axis B1.

An inner diameter of the first connecting portion 410 is greater than an outer diameter of the toner discharge portion 320. Accordingly, the first connecting portion 410 may be pivoted with respect to the toner discharge portion 320 around the hinge protrusion 370 to some extent. An end portion 321 of the toner discharge portion 320 opposite the side wall 301, that is, in the second direction A2, has a shape allowing the first connecting portion 410 to downwardly pivot with respect to the first axis B1. For example, the end portion 321 has a lower end portion 321-1 and an upper end portion 321-2 that is concave with respect to the lower end portion 321-1 in the second direction A2. That is, the lower end portion 321-1 protrudes further from the upper end portion 321-2 in the second direction A2. Although not illustrated in the drawings, the end portion 321 of the toner discharge portion 320 may be downwardly inclined from the upper end portion 321-2 toward the lower end portion 321-1.

According to this configuration, the inner diameter of the first connecting portion 410 may be reduced and a pivot angle of the first connecting portion 410 with respect to the hinge protrusion 370 may be increased at the same time. In addition, in order for the development cartridge 2 to stably rotate between the first position and the second position, the toner supply duct 40 may be downwardly pivoted relative to the first axis B1. By shaping the end portion 321 of the toner discharge portion 320 such that the lower end portion 321-1 protrudes further than the upper end portion 321-2 in the second direction A2, the inner diameter of the first connecting portion 410 may be minimized and a downward pivot angle of the toner supply duct 40 may be increased at the same time.

The image forming apparatus may include a restriction member restricting the pivot angle of the first connecting portion 410 with respect to the first axis B1. An example of a restriction member restricting a pivot angle of the first connecting portion 410 relative to the first axis B1 is provided below with reference to FIGS. 7 and 8.

Figure 7:
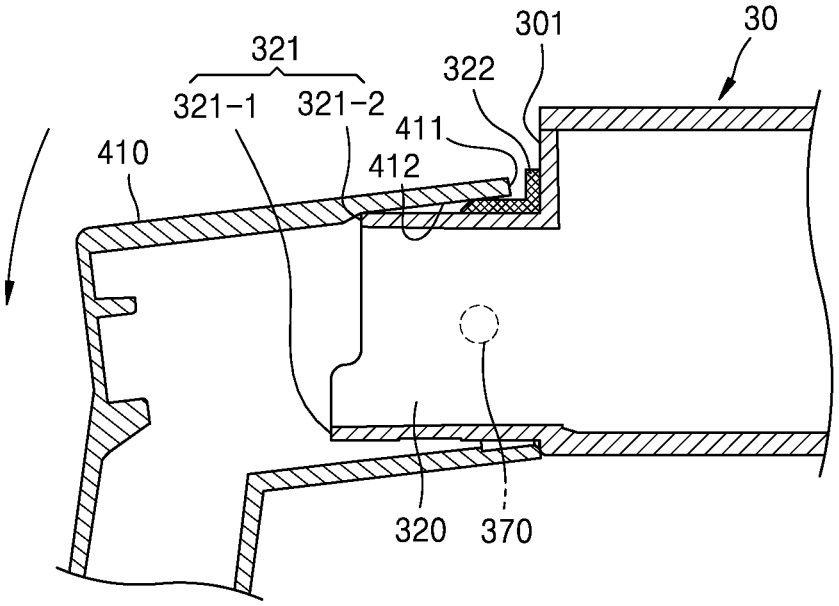
FIG. 7 is a cross-sectional view illustrating a restriction member restricting a downward pivot angle of a first connecting portion with respect to a first axis, according to an example.
Figure 8:
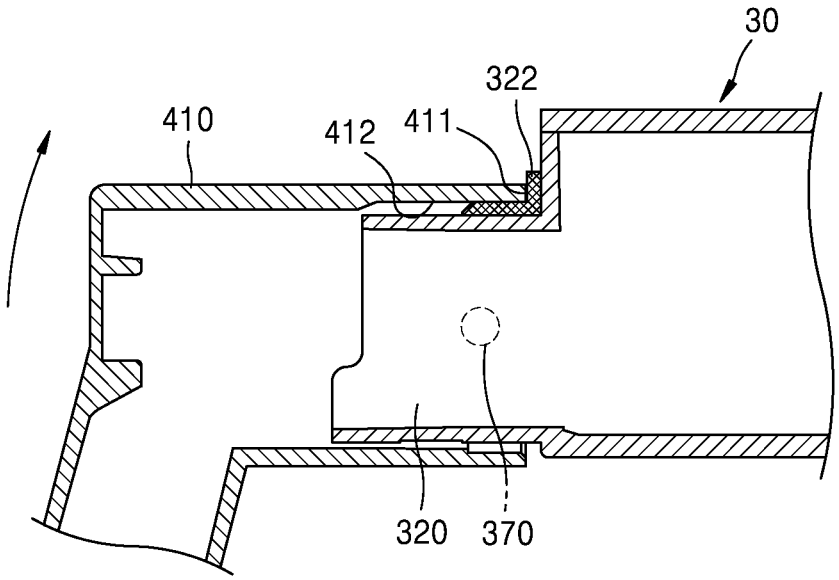
FIG. 8 is a cross-sectional view illustrating a restriction member restricting an upward pivot angle of a first connecting portion with respect to a first axis, according to an example.

FIG. 7 is a cross-sectional view illustrating a restriction member restricting a downward pivot angle of a first connecting portion with respect to a first axis, according to an example. FIG. 8 is a cross-sectional view illustrating a restriction member restricting an upward pivot angle of a first connecting portion with respect to a first axis, according to an example.

Referring to FIGS. 7 and 8, while the development cartridge 2 is mounted in the main body 1, when the switch lever 101 is rotated from the position indicated with the solid line in FIG. 2 toward the position indicated with the dotted line in FIG. 2, the development cartridge 2 is rotated from the first position (indicated with the solid line in FIG. 2) toward the second position (indicated with the dotted line in FIG. 2) by its own weight or by an elastic force of an elastic member. In that case, the toner inlet portion 203 is moved in a direction away from the buffer unit 30. In order to prevent a repulsive force caused by the toner supply duct 40 and disturbing rotation of the development cartridge 2 toward the second position, the first connecting portion 410 may be downwardly pivoted with respect to the hinge protrusion 370 in the state illustrated in FIG. 8. For example, as the inner diameter of the first connecting portion 410 is greater than the outer diameter of the toner discharge portion 320, and the upper end portion 321-2 of the toner discharge portion 320 is concave in the second direction A2 compared to the lower end portion 321-1, the first connecting portion 410 may be downwardly pivoted with respect to the hinge protrusion 370.

As illustrated in FIG. 7, as the downward pivot angle is increased such that the upper end portion 321-2 of the toner discharge portion 320 contacts an inner wall 412 of the first connecting portion 410, the first connecting portion 410 may no longer be downwardly pivoted. Accordingly, the upper end portion 321-2 of the toner discharge portion 320 may act as a restriction member restricting a downward pivot angle of the first connecting portion 410 by contacting the inner wall 412 of the first connecting portion 410 when the first connecting portion 410 is downwardly pivoted. The restricted downward pivot angle may be equal to or greater than a pivot angle of the first connecting portion 410 when the development cartridge 2 has reached the second position.

While the development cartridge 2 is mounted in the main body 1, when the switch lever 101 is rotated from the position indicated with the dotted line in FIG. 2 to the position indicated with the solid line in FIG. 2, the development cartridge 2 is pushed by the switch lever 101 to be rotated from the second position (indicated with the dotted line in FIG. 2) to the first position (indicated with the solid line in FIG. 2). The toner inlet portion 203 is moved in a direction to approach the buffer unit 30. As the development cartridge 2 is rotated from the second position toward the first position, the toner supply duct 40 starts upwardly pivoting with respect to the hinge protrusion 370 from the state illustrated in FIG. 7.

A restriction protrusion may be provided in one of the side wall 301 of the buffer unit 30, from which the toner discharge portion 320 extends, and an end portion 411 of the first connecting portion 410 facing the side wall 301. The restriction protrusion may be provided to face the other one of the side wall 301 and the end portion 411 of the first connecting portion 410. The restriction protrusion may be implemented by, for example, a rib 322 protruding from the side wall 301 of the buffer unit 30. When the first connecting portion 410 is upwardly pivoted, the end portion 411 of the first connecting portion 410 contacts the rib 322. In that case, the first connecting portion 410 may no longer be upwardly pivoted. Accordingly, the rib 322 may act as a restriction member restricting an upward pivot angle of the first connecting portion 410. The restricted upward pivot angle may be equal to or greater than a pivot angle of the first connecting portion 410 when the development cartridge 2 has reached the first position.

According to this configuration, the upward and downward pivot angles of the first connecting portion 410 with respect to the first axis B1 may be restricted.

Referring back to FIG. 3, the toner inlet portion 203 is located on the side wall 202 of the development cartridge 2 in the first direction A1, and the second connecting portion 420 of the toner supply duct 40 may be connected to the toner inlet portion 203. The development cartridge 2 slides in the first direction A1 to be attached/detached to/from the main body 1. Accordingly, before removing the development cartridge 2 from the main body 1, the second connecting portion 420 may be separated from the toner inlet portion 203, and after the development cartridge 2 is mounted in the main body 1, the second connecting portion 420 may be connected to the toner inlet portion 203. In addition, after the second connecting portion 420 is separated from the toner inlet portion 203, the toner supply duct 40 should be located at a position that does not interfere with the development cartridge 2 sliding in the first direction A1.

Considering the above, the first connecting portion 410 may be connected to the toner discharge portion 320 to be pivotable with respect to a second axis B2, which is an axis in the second direction A2. In addition, the second connecting portion 420 may be attachably/detachably connected to/from the toner inlet portion 203 in the first direction A1. According to an example, as illustrated in FIGS. 5 and 6, the hinge hole 440 may have an arc shape with respect to the second axis B2. According to the configuration, the first connecting portion 410 may be pivotably connected to the toner discharge portion 320 with respect to the second axis B2. As pivoting of the first connecting portion 410 with respect to the first axis B1 and the second axis B2 is possible by the hinge hole 440 and the hinge protrusion 370, a two-axis pivot connection between the toner supply duct 40 and the buffer unit 30 is possible via a simple connection structure.

A downward pivot angle and an upward pivot angle of the first connecting portion 410 with respect to the second axis B2 may be restricted by a first end portion 441 and a second end portion 442 of the hinge hole 440. That is, when the first connecting portion 410 is downwardly pivoted with respect to the second axis B2, when the hinge protrusion 370 contacts the first end portion 441 of the hinge hole 440, the first connecting portion 410 is no longer downwardly pivoted. Also, when the first connecting portion 410 is upwardly pivoted with respect to the second axis B2, when the hinge protrusion 370 contacts the second end portion 442 of the hinge hole 440, the first connecting portion 410 is no longer upwardly pivoted. A position of the first end portion 441 of the hinge hole 440 may be determined such that the second connecting portion 420 of the toner supply duct 40 may be naturally connected to the toner inlet portion 203 of the development cartridge 2. A position of the second end portion 442 of the hinge hole 440 may be determined such that the toner supply duct 40 is sufficiently upwardly pivoted to a position where the toner supply duct 40 does not interfere with the development cartridge 2 that is being attached or detached.

Figure 9:
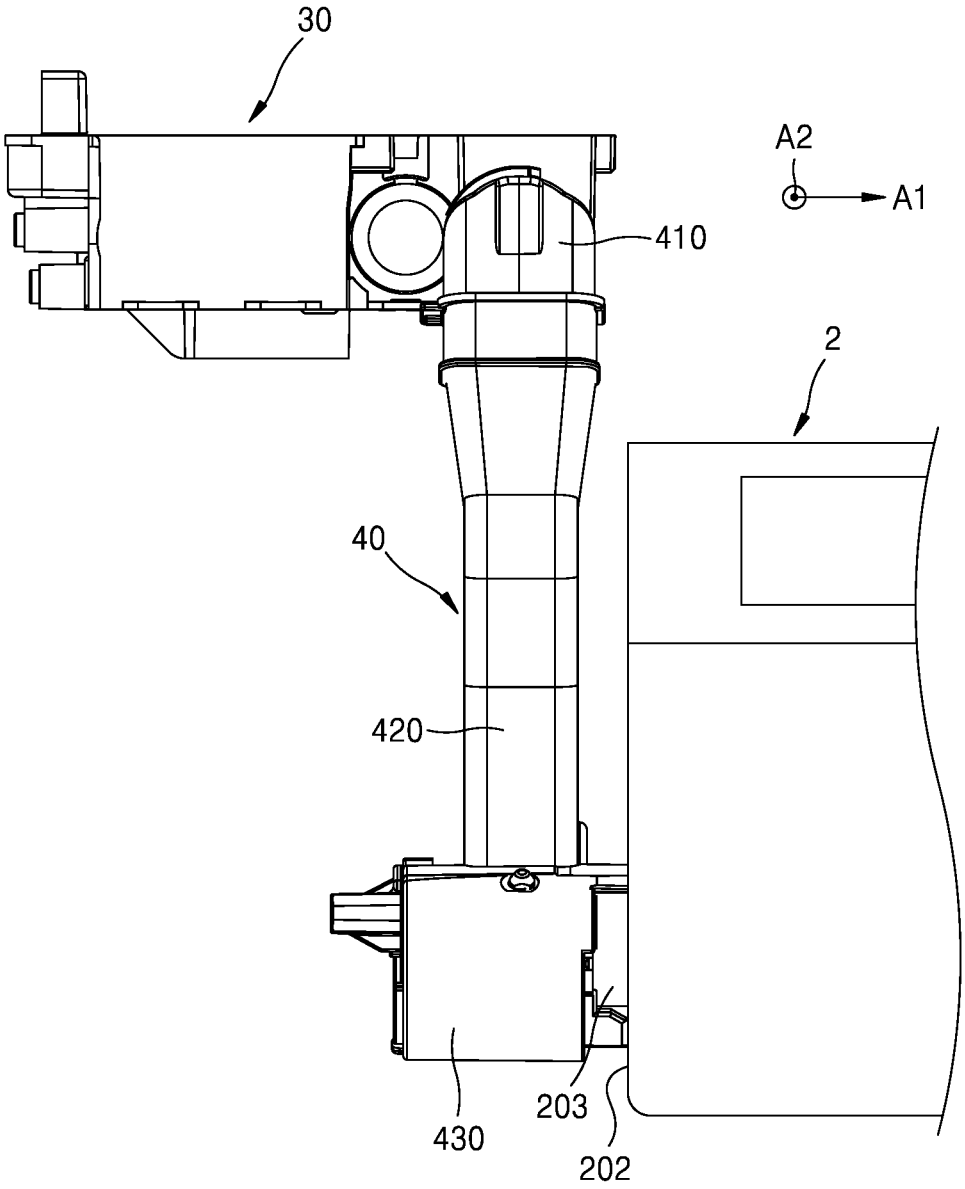
FIG. 9 is a schematic side view taken in a second direction and illustrating a state in which a second connecting portion is connected to a toner inlet portion of a development cartridge, according to an example.
Figure 10:
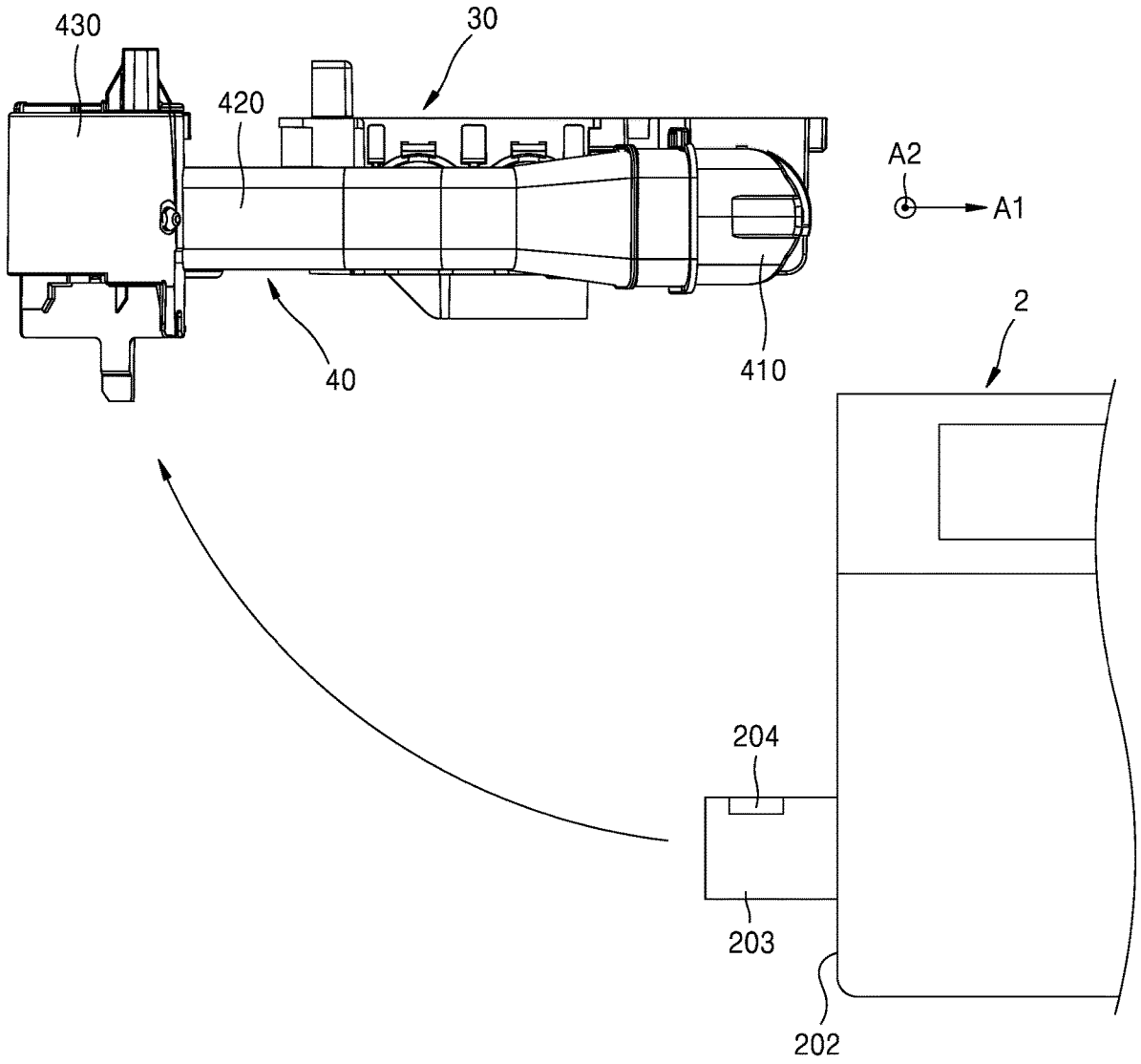
FIG. 10 is a schematic side view taken in a second direction and illustrating a state in which a second connecting portion is released from a toner inlet portion of the development cartridge, according to an example.

FIG. 9 is a schematic side view taken in a second direction and illustrating a state in which a second connecting portion is connected to a toner inlet portion of a development cartridge, according to an example. FIG. 10 is a schematic side view taken in a second direction and illustrating a state in which a second connecting portion is released from a toner inlet portion of a development cartridge, according to an example.

An example process of mounting the development cartridge 2 and the photoconductive cartridge 3 in the main body 1 will be described with reference to FIGS. 2 through 10.

The photoconductive cartridge 3 may be first mounted in the main body 1, or the development cartridge 2 may be first mounted in the main body 1 and then the photoconductive cartridge 3 may be mounted in the main body 1. Hereinafter, an example process of mounting the development cartridge 2 first in the main body 1 and then mounting the photoconductive cartridge 3 in the main body 1 will be described.

As illustrated in FIG. 10, while the toner supply duct 40 is upwardly pivoted with respect to the second axis B2, the development cartridge 2 may slide in the first direction A1 to mount the development cartridge 2 in the main body 1. As illustrated in FIG. 9, the toner supply duct 40 is downwardly pivoted with respect to the second axis B2 to connect the second connecting portion 420 to the toner inlet portion 203 of the development cartridge 2. The switch lever 101 is located at a position indicated with the dotted line in FIG. 2. The development cartridge 2 is located at the second position where the development area is released (indicated with the dotted line in FIG. 2).

In this state, the photoconductive cartridge 3 may slide in the first direction A to be mounted in the main body 1. The first connecting portion 410 of the toner supply duct 40 is pivotably connected to the toner discharge portion 320 with respect to the first axis B1. When the second connecting portion 420 is connected to the toner inlet portion 203, as illustrated in FIG. 7, the toner supply duct 40 is naturally located at a position downwardly pivoted with respect to the first axis B1. The development cartridge 2 may be maintained in the second position. Accordingly, during a process in which the photoconductive cartridge 3 is mounted, interference between the development cartridge 2 and the photosensitive drum 14 is reduced or avoided.

When the photoconductive cartridge 3 is completely mounted, the switch lever 101 is rotated to the position indicated with the solid line in FIG. 2. In that case, the development cartridge 2 is rotated with respect to the hinge axis 201 to be switched to the first position where a development area is formed. Here, the toner inlet portion 203 is moved in a direction to draw near to the buffer unit 30, and as illustrated in FIG. 8, the toner supply duct 40 is upwardly pivoted with respect to the first axis B1. Accordingly, a stable connection between the toner supply duct 40 and the toner inlet portion 203 may be maintained, and the development cartridge 2 may be rotated stably to the first position.

The photoconductive cartridge 3 may also be mounted in the main body 1 after mounting the development cartridge 2 and maintaining the toner supply duct 40 in an upwardly pivoted position illustrated in FIG. 10. In that case, by downwardly pivoting the toner supply duct 40 as illustrated in FIG. 9, the second connecting portion 420 may be connected to the toner inlet portion 203. By rotating the switch lever 101 to the position indicated with the solid line in FIG. 2, the development cartridge 2 may be switched to the first position.

An example process of removing the development cartridge 2 and the photoconductive cartridge 3 from the main body 1 will be described with reference to FIGS. 2 through 10.

When removing the development cartridge 2 first, the second connecting portion 420 is separated from the toner inlet portion 203, and the toner supply duct 40 is upwardly pivoted with respect to the second axis B2 as illustrated in FIG. 10. The switch lever 101 is rotated from the position indicated with the solid line in FIG. 2 toward the position indicated with the dotted line in FIG. 2. The development cartridge 2 is rotated with respect to the hinge axis 201 via its own weight or an elastic force of an elastic member (not shown) to be switched between the first position and the second position. In this state, the development cartridge 2 may be removed from the main body 1.

When removing the photoconductive cartridge 3 first, the development cartridge 2 is switched between the first position and the second position before removing the photoconductive cartridge 3. The switch lever 101 is rotated from the position indicated with the solid line in FIG. 2 to the position indicated with the dotted line in FIG. 2. The development cartridge 2 is rotated with respect to the hinge axis 201 via its own weight or an elastic force of an elastic member (not shown) to be switched between the first position and the second position. Here, the toner inlet portion 203 is moved in a direction away from the buffer unit 30, and as illustrated in FIG. 7, the toner supply duct 40 is downwardly pivoted with respect to the first axis B1. Accordingly, the development cartridge 2 may be stably rotated toward the second position. When the development cartridge 2 is located in the second position, the development area is released. In this state, the photoconductive cartridge 3 may be removed from the main body 1. As the development cartridge 2 may be stably maintained in the second position, while the photoconductive cartridge 3 is being removed, interference between the development cartridge 2 and the photosensitive drum 14 is not generated.

Next, the development cartridge 2 may be removed. First, the second connecting portion 420 is separated from the toner inlet portion 203, and the toner supply duct 40 is upwardly pivoted with respect to the second axis B2 as illustrated in FIG. 10. Next, the development cartridge 2 may slide to be removed from the main body 1.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. An image forming apparatus comprising:

a toner cartridge;

a photoconductive cartridge comprising a photosensitive drum;

a development cartridge comprising:

a developing roller; and a toner inlet portion located below the developing roller, wherein the development cartridge is rotatable between a first position, at which the developing roller is close to the photosensitive drum, and a second position, at which the developing roller is apart from the photosensitive drum, with respect to a hinge axis that is parallel to a first direction which is an axial direction of the developing roller and that is between the developing roller and the toner inlet portion;

a buffer unit, comprising a toner discharge portion extending in a second direction orthogonal to the first direction and forming a discharge path of toner, to receive toner from the toner cartridge and to supply the toner to the development cartridge; and a toner supply duct connecting the toner discharge portion to the toner inlet portion, the toner supply duct being rotatably connected to the toner discharge portion in a direction allowing rotation of the development cartridge between the first position and the second position.

2. The image forming apparatus of claim 1, wherein the toner supply duct comprises:

a first connecting portion pivotably connected to the toner discharge portion with respect to a first axis parallel to the first direction;

a second connecting portion connected to the toner inlet portion; and a connection tube connecting the first connecting portion to the second connecting portion.

3. The image forming apparatus of claim 2, wherein the toner discharge portion has a hollow cylinder form extending from a side wall of the buffer unit in the second direction, the toner discharge portion being inserted into the first connecting portion, and wherein an end portion of the toner discharge portion opposite to the side wall of the buffer unit has an upper end portion and a lower end portion protruding more in the second direction than the upper end portion.

4. The image forming apparatus of claim 3, wherein the toner discharge portion includes a hinge protrusion protruding along the first axis, and wherein the first connecting portion includes a hinge hole into which the hinge protrusion is inserted.

5. The image forming apparatus of claim 4, wherein the upper end portion of the toner discharge portion contacts an inner wall of the first connecting portion to restrict a downward pivot angle of the first connecting portion with respect to the first axis.

6. The image forming apparatus of claim 4, further comprising a restriction protrusion to restrict an upward pivot angle of the first connecting portion with respect to the first axis, the restriction protrusion being provided in one of the side wall and the end portion of the first connecting portion facing the side wall to face the other one of the side wall and the end portion of the first connecting portion facing the side wall.

7. The image forming apparatus of claim 4, wherein the first connecting portion is pivotably connected to the toner discharge portion with respect to a second axis which is an axis in the second direction, and wherein the second connecting portion is detachably connected to the toner inlet portion in the first direction.

8. The image forming apparatus of claim 7, wherein the hinge hole has an arc shape with respect to the second axis.

9. An image forming apparatus comprising:

a toner cartridge;

a photoconductive cartridge comprising a photosensitive drum;

a development cartridge comprising:

a toner inlet portion; and a developing roller;

a buffer unit to receive toner from the toner cartridge and to supply the toner to the development cartridge, the buffer unit comprising a toner discharge portion extending in a second direction orthogonal to a first direction which is an axial direction of the developing roller, and forming a discharge path of the toner; and a toner supply duct comprising a first connecting portion pivotably connected to the toner discharge portion with respect to a first axis parallel to the first direction, a second connecting portion connected to the toner inlet portion, and a connection tube connecting the first connecting portion to the second connecting portion.

10. The image forming apparatus of claim 9, wherein the toner discharge portion has a hollow cylinder form extending from a side wall of the buffer unit in the second direction, the toner discharge portion being inserted into the first connecting portion, and wherein an end portion of the toner discharge portion opposite to the side wall of the buffer unit has an upper end portion and a lower end portion protruding more in the second direction than the upper end portion.

11. The image forming apparatus of claim 10, wherein the toner discharge portion has a hinge protrusion protruding along the first axis, and wherein the first connecting portion has a hinge hole into which the hinge protrusion is inserted.

12. The image forming apparatus of claim 11, wherein the upper end portion of the toner discharge portion contacts an inner wall of the first connecting portion to restrict a downward pivot angle of the first connecting portion with respect to the first axis.

13. The image forming apparatus of claim 12, further comprising:

a restriction protrusion to restrict an upward pivot angle of the first connecting portion with respect to the first axis, the restriction protrusion being provided in one of the side wall and the end portion of the first connecting portion facing the side wall to face the other one of the side wall and the end portion of the first connecting portion facing the side wall.

14. The image forming apparatus of claim 11, wherein the first connecting portion is pivotably connected to the toner discharge portion with respect to a second axis which is an axis in the second direction, and wherein the second connecting portion is detachably connected to the toner inlet portion in the first direction.

15. The image forming apparatus of claim 14, wherein the hinge hole has an arc shape with respect to the second axis.

* * * * *